United States Patent [19]

McAllister

[11] 3,962,828

[45] June 15, 1976

[54] ADJUSTABLE FRAMING MEMBER

[75] Inventor: Owen Earl McAllister, Oshkosh, Wis.

[73] Assignee: Combustion Engineering, Inc., Windsor, Conn.

[22] Filed: Aug. 1, 1974

[21] Appl. No.: 493,597

[52] U.S. Cl. ..... 49/468

[51] Int. Cl.[2] ..... E06B 1/70

[58] Field of Search ..... 49/468, 471, 467, 469, 49/470

[56] References Cited

UNITED STATES PATENTS

| | | | |
|---|---|---|---|
| 596,948 | 1/1898 | Seely | 49/468 |
| 1,908,623 | 5/1933 | Barringer | 49/471 X |
| 3,072,976 | 1/1963 | Klaas | 49/468 |
| 3,173,287 | 9/1966 | Pease, Jr. | 49/468 |
| 3,475,866 | 11/1969 | Johansen | 49/468 |
| 3,521,404 | 7/1970 | Hager et al. | 49/469 X |

*Primary Examiner*—Philip C. Kannan
*Attorney, Agent, or Firm*—Stephen L. Borst

[57] ABSTRACT

An adjustable wall penetration framing member which is adjustable at any point by raising or lowering an adjustment screw and which prevents the infiltration of water and air into the interior of a building through the adjustable member.

4 Claims, 1 Drawing Figure

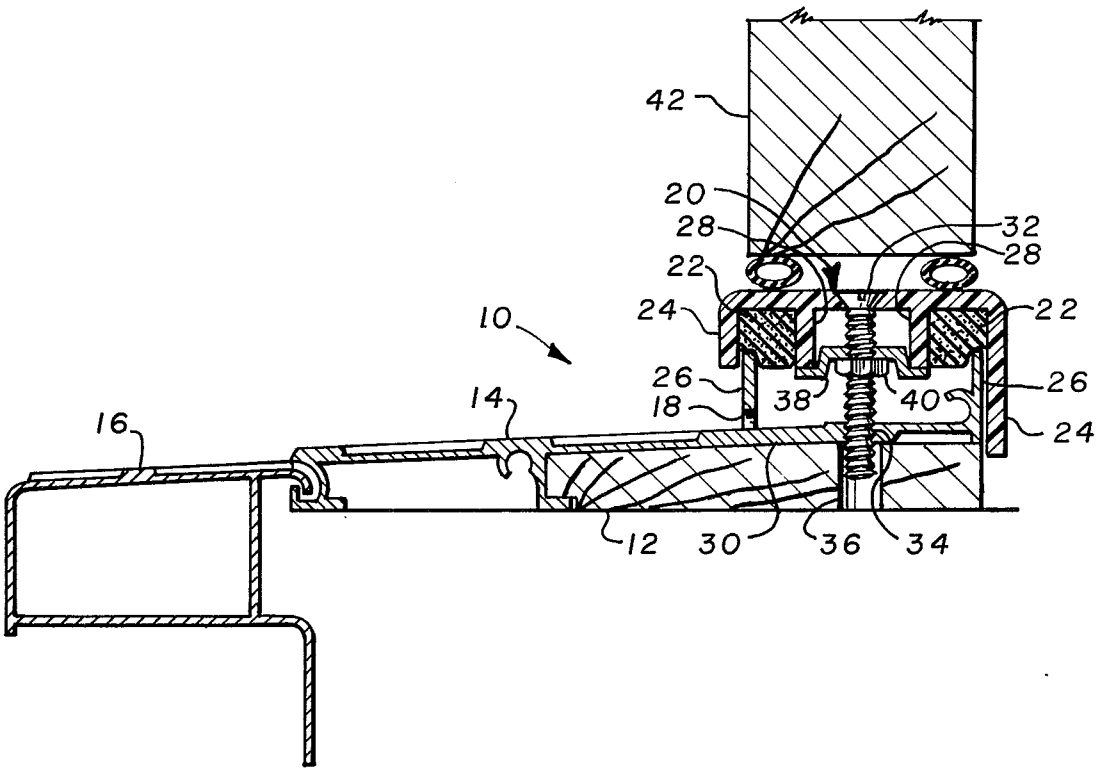
42
20
28
22
24
26
18
38
40
32
28
22
26
24
34
36
30
12
10
14
16

ADJUSTABLE FRAMING MEMBER

BACKGROUND AND HISTORY OF THE INVENTION

The present invention relates to an adjustable wall penetration framing member of the type that can be positioned in an existing door opening or any external or internal wall penetration of conventional construction and of the type that can be adjusted to accommodate irregularities in the rough opening.

It is frequently desired to improve old building units and to replace the doors provided in the old buildings with up-to-date and modern replacement doors. There is usually some difficulty associated with this replacement since the door frequently must be cut to special sizes and shapes. This is particularly true of the threshold of either an old or a new doorway which must be positioned on warped or distorted floor boards. Accordingly, it is an object of this invention to provide a complete adjustable door frame member, especially an adjustable threshold, which may be inserted into an old or a new doorway or other external or internal wall penetration which, for one reason or another, may be out of square, warped or irregular. The adjustable member must not only have the ability to accommodate the irregularities of the opening but also, in the case of an outside door, must be impervious to the elements such as wind and rain.

SUMMARY OF THE INVENTION

An adjustable wall penetration framing member is provided which is not only easily adjustable to accommodate wall penetration irregularities but which also prevents the infiltration of wind or rain through the adjustable member. The member consists of a first trough or channel which is fastened on the inside of the wall penetration with its open side facing the penetration cavity. Over this open trough is slid a second open trough with its open side facing away from the cavity. Between the first and second open troughs is positioned a weatherseal material which preferably is a resilent deformable water impervious skinned foam. A plurality of spaced screws in threaded engagement with the first open trough holds the second open trough in a position relative to the first open trough. A bracket and nut fixed on the screw engage the underside of the second open trough to assist in the positioning thereof. Each of the plurality of screws is accessible through the second trough thereby permitting easy adjustment of the relative positions of the two troughs. The apparatus of the invention is particularly suitable for an adjustable door threshold although it may be adapted for use as any portion of the complete door frame or for use as any portion of any part of the frame for framing a wall penetration.

BRIEF DESCRIPTION OF THE DRAWING

The present invention may be better understood and its numerous objects and advantages will become apparent to those skilled in the art by reference to the accompanying drawing in which FIG. 1 illustrates a cross-sectional view of the adjustable complete door frame member.

DESCRIPTION OF THE PREFERRED EMBODIMENT

Referring now to FIG. 1, the invention has been illustrated in the embodiment of an adjustable threshold 10. The threshold consists of an aluminum sill band 16 which engages an aluminum basic sill 14 which rests on a wooden substrate 12. The aluminum basic sill 14 in part consists of an upwardly facing open trough or channel 30 which has relatively spaced sidewalls 26. Fitting over the channel 30 in sliding relationship is a high rise threshold 20. High rise threshold 20 may consist of any suitable material such a polyvinyl chloride or extruded aluminum. The high rise threshold 20 includes relatively spaced sidewalls 24 on each side thereof and also relatively spaced ribs 28 which extend along at least a portion of the length of the elongated trough 20. In its assembled configuration the high rise threshold 20 has an outer side which lies adjacent to the bottom of the closed door 42 and an inner side which faces the base 30. The high rise threshold 20 with the relatively spaced sidewalls 24 is adapted to slidingly fit over the channel 30 and the relatively spaced sidewalls 26 of the channel 30. The ribs 28 on the inside of the high rise threshold 20 define three compartments on the interior of the trough 20. The middle compartment contains adjusting means which permit the relative adjustment of the high rise threshold 20 with respect to the base member 30. The outermost two compartments defined by the ribs 28 are filled with a weatherseal means 22 which contacts both the high rise threshold 20 and at least a portion of the open channel base member 30. By this weatherseal means 22, water and air penetration from the outside of the doorframe to the interior of the structure is prevented or at least substantially reduced. In a preferred embodiment the weatherseal means is a resilient, deformable water impervious material such as skinned foam. Also in a preferred embodiment of the invention as illustrated in FIG. 1, the threshold is built with a slight outward and downward pitch so that rain water drains away from the door unit. Accordingly, the high rise section of the threshold is at the highest position of the threshold and water does not have a tendency to accumulate therein. To further assure that water is not trapped in a pool in the channel section 30, weep holes 18 are drilled in the exterior sidewall 26 of base 30 to facilitate the drainage of the adjustable threshold section.

Continuing the description of the adjustable high rise section of the threshold 10, the adjustable portion 20 of the high rise threshold is fastened to the base member 30 by means of screw 32. Screw 32 penetrates through the trough 20 and is accessible therethrough for adjustment. Screw 32 engages the exterior surface of the trough 20 to hold the trough 20 down. Screw 32 also engages channel 30 in threaded engagement by means of threaded opening 34 so that by turning the screw 32 in a clockwise direction the threshold is lowered and by turning the screw 32 in a counterclockwise direction the threshold is raised. In order to accommodate the adjustable motion of the screw 32 a hole 36 is drilled in the substrate 12. In addition to the head of the screw 32 which holds down the adjustable threshold member 20 the adjustable means includes bracket 38 carried by screw 32 and held in position by a lock-nut 40. The bracket 38 engages an inner portion of the adjustable member 20 (the ribs 28 as shown in the illustration)

and is held in its axial position by the lock-nut 40. The lock-nut 40 locks to the threaded screw in a fixed position so that by turning the screw 32 the nut 40 is also caused to turn relative to the bracket 38. By this means adjustable threshold member 20 is held between the head of the screw 32 and the bracket 38 so that when the screw is raised or lowered the adjustable threshold member 20 is also raised or lowered. It should be recognized that in the above discussion of the adjustable threshold of the instant invention the member is elongated and has a plurality of adjusting means located at spaced positions along the length of the elongated members.

What is claimed is:

1. An adjustable wall penetration framing member for defining at least a portion of the opening of the penetration wherein the wall penetration member comprising:

a. an elongated open trough having spaced sidewalls on each side thereof, said open trough having inner and outer sides and said open trough having its outer side facing said opening of said wall penetration;

b. an elongated base comprising an open channel having relatively spaced side walls on each side thereof, said open channel having its open side facing said open trough and said open channel being adapted to slidingly fit into said open trough;

c. means positioned on said inner side of said open trough between said spaced side walls for effecting a weatherseal between said open trough and said base member; and d. a plurality of adjustable means positioned along the length of said base and said trough for providing relative adjustment therebetween and for fixing said trough and said base in selected adjusted positions.

2. An adjustable wall penetration framing member for defining at least a portion of the opening of the penetration, wherein the wall penetration member comprising:

a. an elongated base member;

b. an elongated open trough having spaced sidewalls on each side thereof, said open trough having inner and outer sides and said open trough being positioned adjacent said base member with its open or inner side facing said base member;

c. means positioned on said inner side of said open trough between said spaced sidewalls for effecting a weatherseal between said open trough and said base member; and d. a plurality of adjustable means positioned along the length of said base and said trough for providing relative adjustment therebetween and for fixing said trough and said base in selected adjusted positions, said adjustable means comprising a threaded member received in threaded engagement with said base member, and means mounted on said threaded member for holding said open trough relative to said base member including means axially mounted on said threaded member for engaging the inner surface of said trough and for restricting movement of said trough towards said base, said axially mounted means including a bracket carried by said threaded member and a lock-nut which engages said bracket and locks onto said threaded member in a fixed axial position.

3. An adjustable wall penetration framing member for defining at least a portion of the opening of the penetration, wherein the wall penetration member comprising:

a. an elongated base member;

b. an elongated open trough having spaced sidewalls on each side thereof, said open trough having inner and outer sides and said open trough being positioned adjacent said base member with its open or inner side facing said base member, said elongated trough including two inner ribs extending along at least a portion of the length of said trough;

c. means positioned on said inner side of said open trough in compartments formed between said spaced sidewalls and said inner ribs for effecting a weatherseal between said open trough and said base member; and d. a plurality of adjustable means positioned along the length of said base and said trough and engaging said inner ribs of said elongated trough for providing relative adjustment therebetween and for fixing said trough and said base in selected adjusted positions.

4. The adjustable wall penetration framing member as recited in claim 3 wherein:

a. said elongated base comprising an open channel having relatively spaced sidewalls on each side thereof, is an open channel having its open side facing said open trough and said open channel being adapted to slidingly fit into said open trough;

b. said adjustable means for providing relative adjustment between said base and said trough including a threaded member received in threaded engagement with said base, said threaded member engaging the outer surface of said open trough and adjustable therethrough, and said threaded member carrying means for engaging an inner portion of said trough and for restricting movement of said trough relative to said base; and c. said means positioned on said inner side of said open trough between said relatively spaced sidewalls for effecting a weatherseal between said open trough and said base member comprising a resilient, deformable, water impervious material.

* * * * *